US006340143B1

(12) United States Patent
McCraney

(10) Patent No.: US 6,340,143 B1
(45) Date of Patent: Jan. 22, 2002

(54) FASTENING APPARATUS

(75) Inventor: William J. McCraney, Laguna Hills, CA (US)

(73) Assignee: Watts Investment Co., Wilmington, DE (US)

( * ) Notice: Subject to any disclaimer, the term of this patent is extended or adjusted under 35 U.S.C. 154(b) by 0 days.

(21) Appl. No.: 09/636,199

(22) Filed: Aug. 10, 2000

Related U.S. Application Data

(60) Division of application No. 09/097,369, filed on Jun. 15, 1998, now Pat. No. 6,145,796, which is a continuation-in-part of application No. 09/069,372, filed on Apr. 29, 1998, now abandoned.

(51) Int. Cl.[7] ..... A47G 23/02
(52) U.S. Cl. ..... 248/154; 248/313
(58) Field of Search ..... 248/153, 313, 248/310, 312, 217.3, 216.1, 546; 24/197, 68 CD, 164, 318

(56) References Cited

U.S. PATENT DOCUMENTS

| | | | |
|---|---|---|---|
| 1,182,564 | A | 5/1916 | Holden |
| 1,321,305 | A | 11/1919 | Heald |
| 1,473,817 | A | 11/1923 | Gorsline |
| 1,574,608 | A | 2/1926 | Cordley et al. |
| 1,621,245 | A | 3/1927 | Flowers |
| 1,694,000 | A | 12/1928 | Cole |
| 1,760,036 | A | 5/1930 | Bellows |
| 2,277,738 | A | 3/1942 | Wilkinson |
| 2,324,252 | A | 7/1943 | Woelfer |
| 2,336,319 | A | 12/1943 | Tinnerman |

(List continued on next page.)

FOREIGN PATENT DOCUMENTS

FR 1087232 2/1955

OTHER PUBLICATIONS

Advertisement—Spacemaker Company—Spacemaker Freestanding Tank Restraint System, published more than one year prior to the filing date of Apr. 29, 1998.

Advertisement—Columbia Supply Co. (Spacemaker Water Heater Support Products) Reeves Journal, Cover and p. 109, Jan. 1996.

Advertisement—Hubbard Enterprises—Quick Strap 50 By Holdrite, Reeves Journal, Cover and p. 4, Apr. 1997.

Advertisement—Spacemaker Company—Spacemaker 52 Gallon Water Heater Restraints, published more than one year prior to the filing date of Apr. 29, 1998.

Advertisement—Spacemaker Company—Spacemaker Model E–25 Water Heater Earthquake Restraints, published more than one year prior to the filing date of Apr. 29, 1998.

*Primary Examiner*—Ramon O. Ramirez
(74) *Attorney, Agent, or Firm*—Fish & Richardson, P.C.

(57) ABSTRACT

The instant invention is directed to an apparatus and methods for restraining a water heater to a supporting structure, such as a wall. The fastening system includes at least one bracket which mounts to the supporting structure and at least one restraining strap, one end of which attaches to a bracket, the other end of which can attach to another bracket, or mount directly to the wall, to hold the water heater tightly against the supporting structure. In some embodiments, the strap is long enough to encircle the water heater. In other embodiments, the strap can be split into two straps and joined at the water heater with tension buckles. In the preferred embodiment, two straps are used, and both are secured to the supporting structure with brackets. One of the straps encircles the water heater, and both connect to each other at the water heater through tension buckles. In the preferred embodiment, the connection of a strap to its tension buckle is made by a single slot, which contains a pointed tab which pierces a hole in the strap to securely fasten the strap to the tension buckle.

21 Claims, 15 Drawing Sheets

U.S. PATENT DOCUMENTS

| | | | | | |
|---|---|---|---|---|---|
| 2,418,539 | A | | 4/1947 | Anderson | |
| 2,474,668 | A | | 6/1949 | Herbolsheimer | |
| 2,937,766 | A | | 5/1960 | Penn | |
| 3,162,916 | A | * | 12/1964 | McHugh | 24/198 |
| 3,319,983 | A | | 5/1967 | Zibell | |
| 3,334,851 | A | | 8/1967 | Cassidy et al. | |
| 3,519,233 | A | | 7/1970 | Logsdon | |
| 3,875,873 | A | | 4/1975 | Howitt | |
| 4,267,998 | A | | 5/1981 | Weirich | |
| 4,344,645 | A | | 8/1982 | Kirk | |
| 4,442,994 | A | | 4/1984 | Logsdon | |
| 4,614,007 | A | * | 9/1986 | Esle | 24/136 R |
| 4,843,689 | A | * | 7/1989 | Fildan | 24/200 |
| 4,955,573 | A | | 9/1990 | Horvath | 248/313 |
| 5,020,760 | A | | 6/1991 | Mayr | 248/313 |
| 5,131,856 | A | * | 7/1992 | Auclair | 439/100 |
| 5,190,260 | A | | 3/1993 | Daubenspeck | |
| 5,199,676 | A | | 4/1993 | Kowaleski | |
| 5,201,484 | A | | 4/1993 | Thoen | |
| 5,368,263 | A | | 11/1994 | Harrison | |
| 5,487,518 | A | | 1/1996 | McCraney et al. | 248/225.11 |
| 5,607,133 | A | * | 3/1997 | Markham et al. | 248/313 |
| 5,612,509 | A | | 3/1997 | Market | |
| 5,685,590 | A | | 11/1997 | Harrison | |
| 5,791,264 | A | | 8/1998 | McCraney | |
| 5,897,086 | A | * | 4/1999 | Condon | 248/154 X |
| 5,971,336 | A | | 10/1999 | McCraney | |
| 5,996,949 | A | | 12/1999 | McCraney | |
| 6,073,900 | A | * | 6/2000 | Chapman | 248/313 |
| 6,145,796 | A | | 11/2000 | McCraney | |
| 6,182,613 | B1 | | 2/2001 | McCraney | |

* cited by examiner

FASTENING APPARATUS

This application is a continuation of application Ser. No. 09/097,369, filed Jun. 15, 1998, now U.S. Pat. No. 6,145,796, which is a continuation-in-part of application Ser. No. 09/069,372, filed Apr. 29, 1998 now abandoned, for an apparatus and method for securing a water heater to a wall utilizing straps.

FIELD OF THE INVENTION

This invention is directed to apparatus and methods for securing a water heater to a supporting structure utilizing straps.

BACKGROUND OF THE INVENTION

Water heaters provide a valuable convenience in the modern home in that they supply hot water to the occupants of the household upon demand. Unfortunately, water heaters also introduce dangers into the home. Indeed, natural disasters, such as, for example, earthquakes or flooding, can cause the water heater to overturn or pull from the wall such that damage to the gas line occurs causing the release of natural gas which can then ignite. The igniting of the natural gas can destroy the house, and potentially the occupants, if the fire is not immediately contained.

In an effort to avoid such disasters, some state legislatures, e.g., California, have passed laws requiring the securing of the water heater to the wall or to the floor. These requirements have aided in reducing the number of disasters caused from damaged water heaters.

One device directed to the restraint of water heaters is described in U.S. Pat. No. 5,487,518 to McCraney. In the McCraney reference, an elongated strut is secured to a wall. Strapping is attached to a pair of triangular gussets which are then attached to the strut and connected together with a pair of tensioning buckles. The gussets are slidably coupled to the strut such that the gussets can be independently positioned depending upon the position of the studs in the wall. Although this design provides a sturdy restraint, it is time consuming to install due to the numerous parts. Another drawback of this design is the difficulty encountered in threading the straps through the two slots in the tensioning buckle. Further, the design in the McCraney reference does not allow the water heater to be retrofitted; rather, the water heater must be removed from the wall to install the restraint. Additionally, this design is limited in the scope of installation in that the elongated strut requires a flat wall for attachment, thus, the water heater must also be located against this flat wall.

A need exists in the industry for a restraining device that is safe, inexpensive and allows for ease of installation. Further, a need exists for a restraining device that can be retrofitted to existing water heaters such that the water heater does not need to be removed from the wall to install the restraining device. A need further exists for a restraining device that allows installation of the water heater with varying types of spaces, such as, rounded corners.

SUMMARY OF THE DISCLOSURE

The instant invention is directed to an apparatus and method for securing a water heater, and the like, to a wall or floor that is capable of retrofitting currently installed water heaters, and further allows installation in virtually any type of environment. Further, embodiments of the instant invention include flexible brackets that directly grip the restraining strap such that the strength and integrity of the restraining strap at the brackets is retained. However, it should be noted that lower cost embodiments, where strap length adjustability at a wall is not required, include versions where the strap is attached directly, without a bracket, to a wall or floor through a hole in the strap.

Preferred embodiments of the instant invention include restraining straps and a plurality of brackets, wherein the brackets are configured to receive the straps. A first end of the straps are threaded through the brackets which are then attached to the studs in the wall. The straps are then coupled together in the front of the water heater. In one preferred embodiment, at least one of the straps is as long as the measured circumference of the water heater. Other preferred embodiments further include tension buckles and a spacer.

In embodiments utilizing tension buckles, the second end of the straps are threaded through tension buckles which reside in the front of the water heater. The tension buckles are coupled together such that the straps snugly secure the water heater. A spacer is threaded through the straps prior to securing the straps to the tension buckles. The spacer is placed in the back of the water heater between the water heater and the wall. This aids in preventing the water heater from damaging or being damaged by hitting the wall.

Another advantage to the preferred embodiment of the new tension buckle is ease of installation. The new tension buckle with tab is much easier to install than the previous two slot tension buckle because one simply slides the strap through one slot, instead of the two slots on the previous tension buckle. The tab in the first slot engages with one of several perforations in the strap to provide for secure attachment, without a second slot. A further advantage of the tension buckle with pointed tab is that as the strap is tightened, the pointed tab pierces its own hole in the strap so it can provide secure attachment without the need for either a perforated strap or second slot.

Another feature of embodiments of the instant invention is that the length of the restraining straps can be adjusted. Advantages of the adjustability of the length of the straps is that the device is operable with larger or smaller size water heaters.

A further feature of embodiments of the instant invention is that there are relatively few pieces comprising the restraint. An advantage of fewer parts is that installation of the restraining device is easy.

Still a further feature of embodiments of this invention is that the buckles can be installed in any position. At least one advantage of this feature is that the restraining device is not limited in the environment required for installation. A further advantage of this feature is that the water heater does not have to be removed from the wall to install the restraining device, thereby allowing previously installed water heaters to be retrofitted with the restraining device.

A feature of the brackets in preferred embodiments is that the brackets allow the storage of the ends of the straps to be folded behind the water heater. An advantage of this feature is that the safety of the fastening system is enhanced as the potentially sharp edges of the straps are less exposed to people walking by the water heater.

Another feature of preferred embodiments of the instant invention include a spacer that, in operation, is disposed between the water heater and the wall. An advantage to this feature is that in instances wherein a separation of the water heater from the wall is required, for example, in non-zero clearance water heaters, the spacer is a true retrofit and holds the water heater from the wall, thereby, increasing the safety of the water heater.

The above and other advantages of embodiments of this invention will be apparent from the following more detailed description when taken in conjunction with the accompanying drawings. It is intended that the above advantages can be achieved separately by different aspects of the invention and that additional advantages of this invention will involve various combinations of the above independent advantages such that synergistic benefits may be obtained from combined techniques.

BRIEF DESCRIPTION OF THE DRAWINGS

The detailed description of preferred embodiments of the invention will be made with reference to the accompanying drawings, wherein like numerals designate corresponding part the figures.

DETAILED DESCRIPTION OF THE PREFERRED EMBODIMENTS

Figure 1:
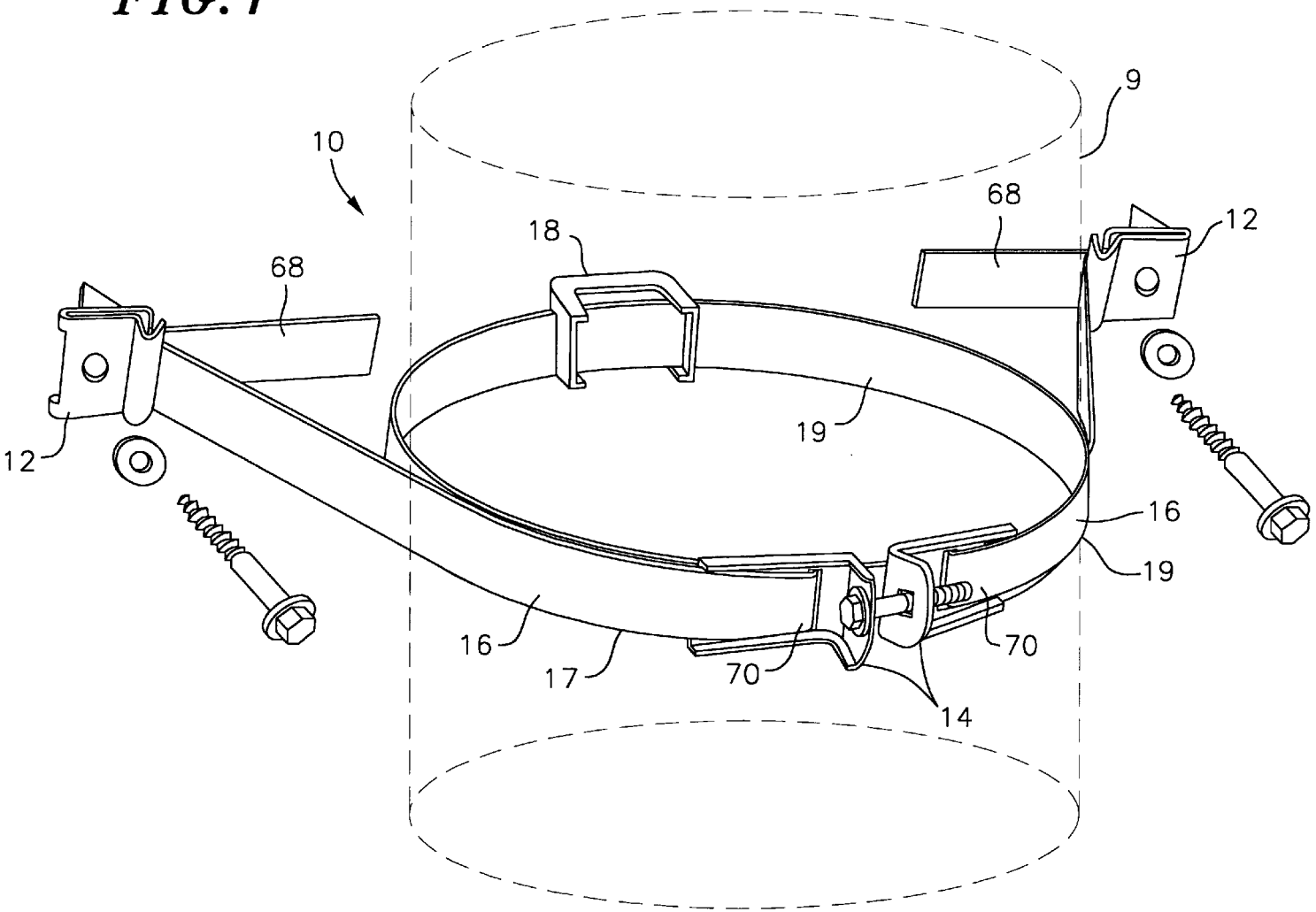
FIG. 1 is a perspective view of the fastening system of the present invention.

Preferred embodiments of the instant invention are directed to an apparatus and a method for fastening a water heater 9, or the like, to the wall of a dwelling or other structure to increase safety in the building. With reference to FIG. 1, preferred embodiments of the fastening system 10 include a plurality of brackets 12, tension buckles 14, straps 16 and a spacer 18.

Figure 2A:
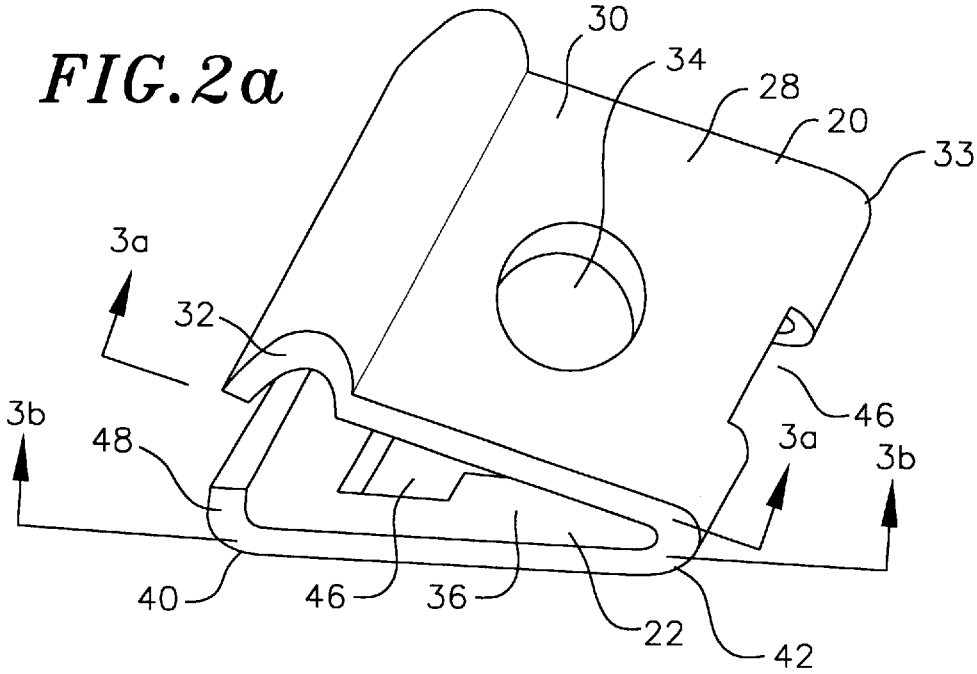
FIG. 2*a* is a perspective view of the bracket of the fastening system in FIG.
Figure 2B:
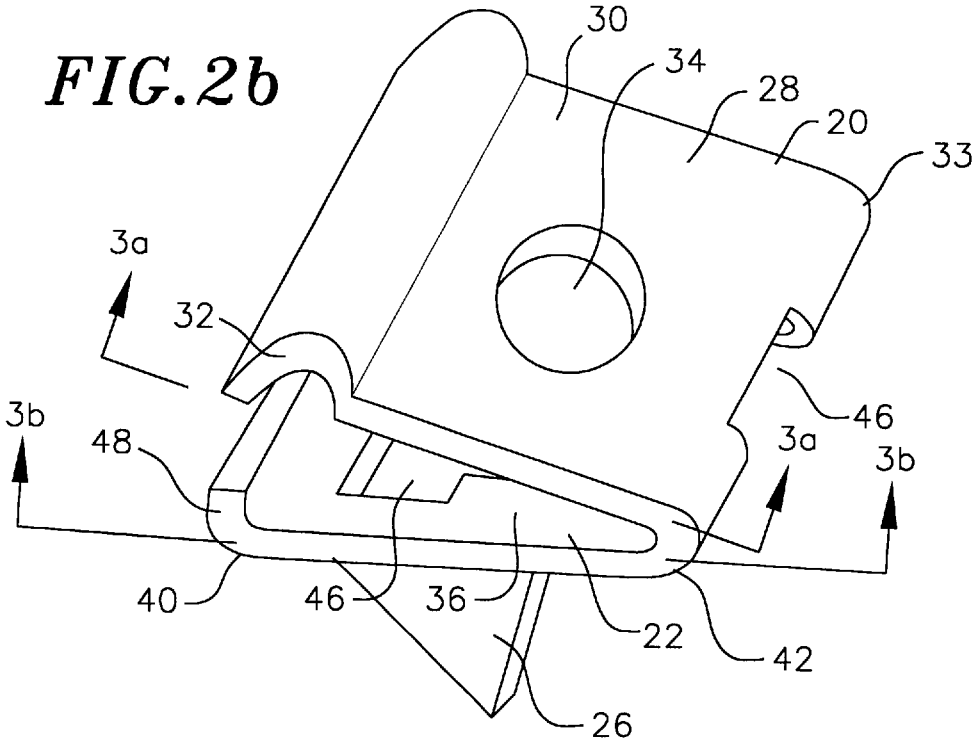
FIG. 2*b* is a perspective view of the bracket in FIG. 2*a*, wherein the bracket further includes a tooth.
Figure 2D:
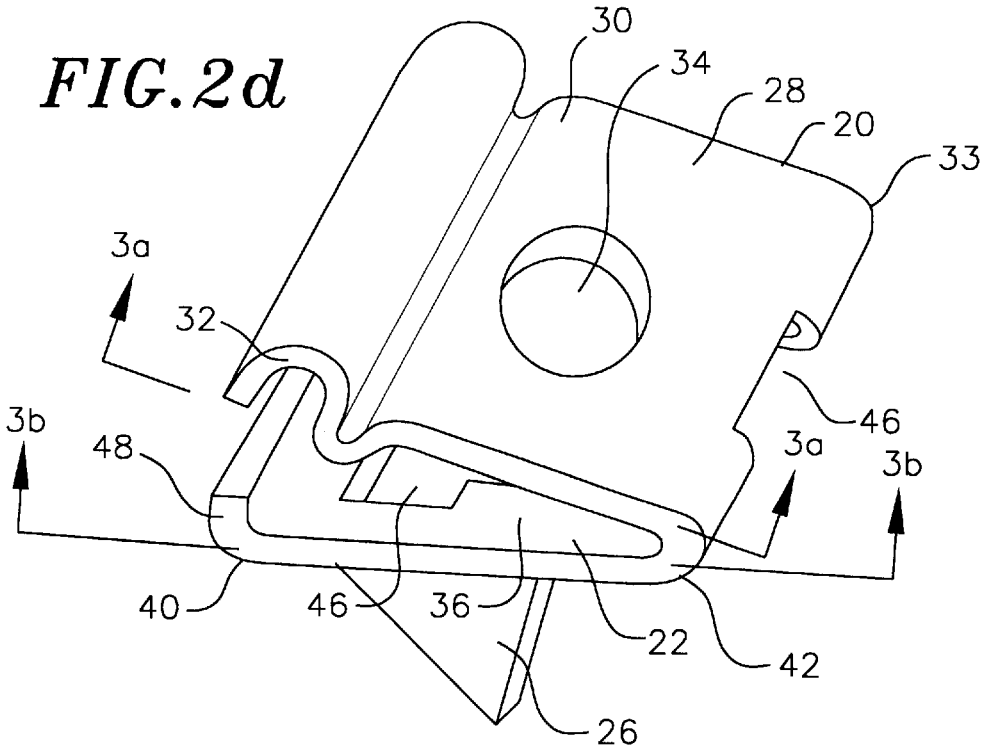
FIG. 2*d* is a perspective view of the alternative bracket in FIG. 2*c*, wherein the bracket further includes a tooth.
Figure 3B:
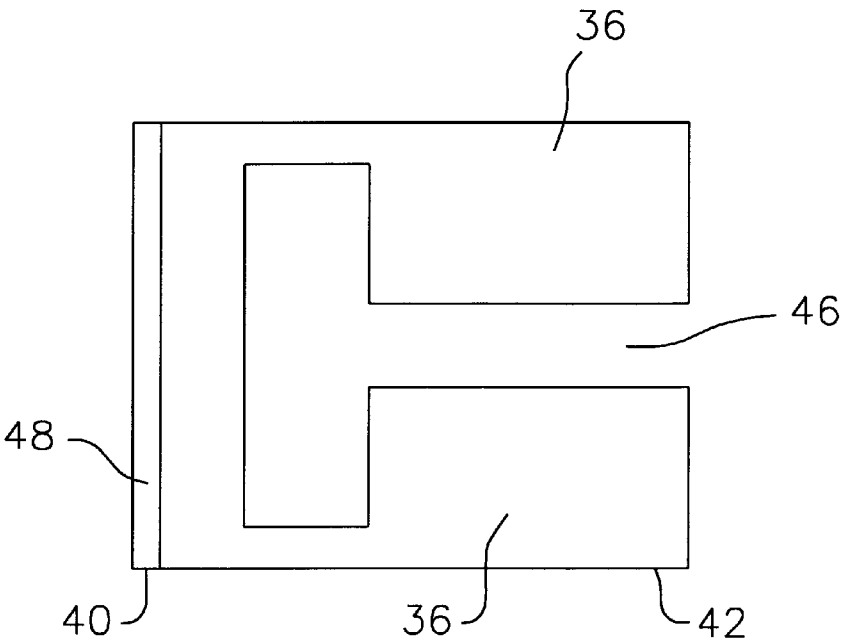
FIG. 3*b* is a top sectional view of the bracket shown in FIG. 2*a* taken along line 3*b*—3*b*.
Figure 3A:
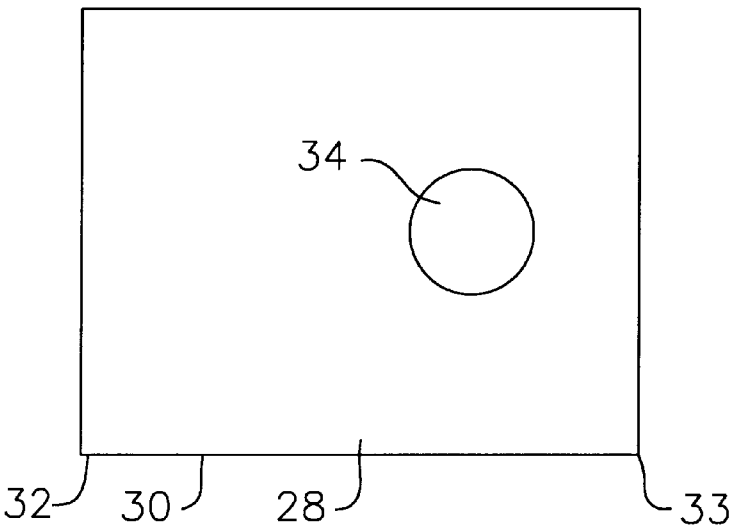
FIG. 3*a* is a top view of the bracket shown in FIG. 2*a*.

With reference to FIG. 2*a*, the brackets 12 include a top member 20 and a bottom member 22. In some embodiments the brackets 12 further include at least one tooth 26 (FIGS. 2*b* and 2*d*). The top member 20 includes a planar member 28, and a channel member 32, wherein the planar member 28 includes a first end 30 and a second end 33 and wherein the channel member 32 is coupled to the first end 30 and extends along the width of the top member 20. The planar member 28 further includes an aperture 34 capable of receiving a fastener, such as, for example, a screw or nail. In preferred embodiments, the aperture 34 is elongated in shape, such as, for example, oval, although any shape that is capable of allowing the passage of the fastener, e.g., a screw, in the open and closed position of the bracket 12 is suitable. With reference to FIG. 3*a*, the planar member 28 is rectangular in shape, although other shapes, such as, for example, a square, may be suitable.

Figure 2C:
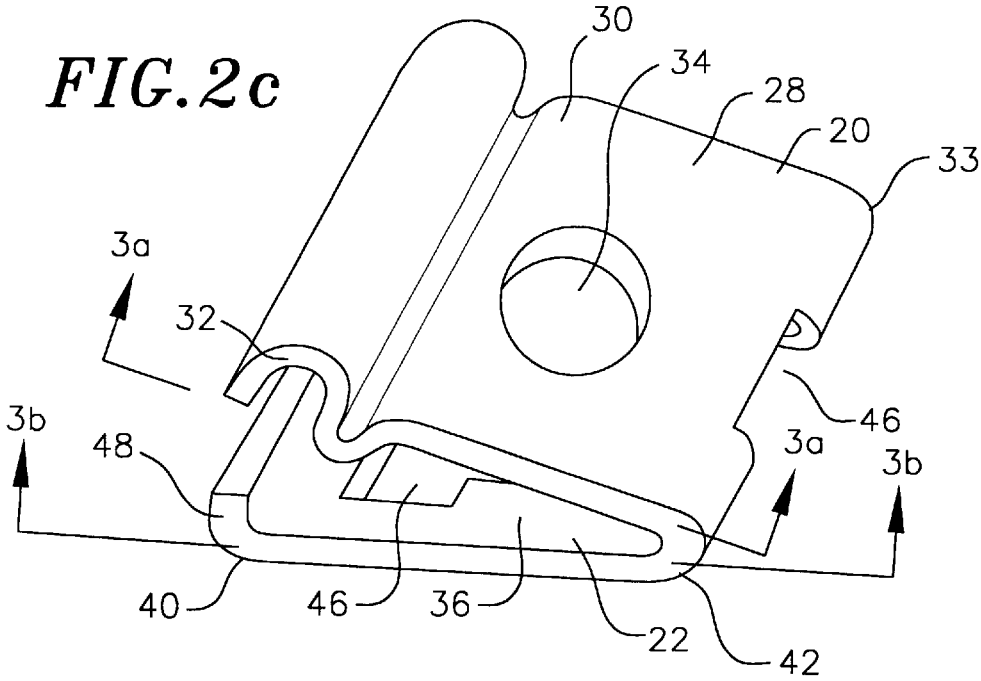
FIG. 2*c* is a perspective view of an alternative bracket of the fastening system in FIG. 1.

With reference to FIGS. 2*a*–2*c*, the channel member 32 is shaped as an inverted U, although any shape of the channel member 32, such as, for example, a rectangle, is suitable. The channel member 32 is coupled to the first end 30 of the planar member 28, wherein the coupling between the channel member 32 and the first end 30 can be direct, as shown in FIG. 2*a*, or with a U-shaped channel 38, as shown in FIG. 2*c*.

The bottom member 22 includes a first end 40, a second end 42, and legs 36. An aperture 46 is formed by the space between the legs 36. The first end 40 further includes a lip 48 which extends along the width of the bottom member 22 towards the top member 20. The lip 48 is configured such that it is capable of being received within the channel member 32 of the top member 20 to form a lock. With reference to FIG. 3*b*, the aperture 46 of the bottom member 22 is larger than the aperture 34 of the top member 20 and thus at least a portion of the aperture 46 aligns with the aperture 34 in the top member 20. The aperture 46 is capable of receiving a fastener, e.g., a screw, and a restraining member 16, e.g., a strap, which is further discussed below. However the aperture 46 must be sized such that it does not weaken the integrity of the bracket 12. Typically, the aperture 46 is T-shaped, although any shape, such as, for example, a square or cross, which is capable of receiving both a coupling member and a restraining member in addition to maintaining the integrity of the bracket 12 is suitable.

Referring again to FIG. 2*a*, the second end 33 of the planar member 28 couples to the second end 42 of the bottom member 22 via the legs 36 in a hinge-like manner. When the top member 20 and the bottom member 22 are coupled together, the first end 40 and the channel member 32 are outwardly biased with respect to each other. In some preferred embodiments, the top member 20 may be coupled to the bottom member 22 by a hinge.

With reference to FIGS. 2*b* and 2*d*, the tooth 26 is a spike-like member having a triangular shape, wherein the apex of the triangle is configured to puncture through a supporting structure in the environment, such as, for example, a wall or stud. The tooth 26 is coupled to the bottom member 22 and extends perpendicular therefrom. Preferably, at least two teeth 26 are coupled to the bottom member 22, although in some preferred embodiments, a single tooth 26 can be coupled to the bottom member 22. The teeth 26 aid in securing the brackets 12 to the wall.

Figure 4:
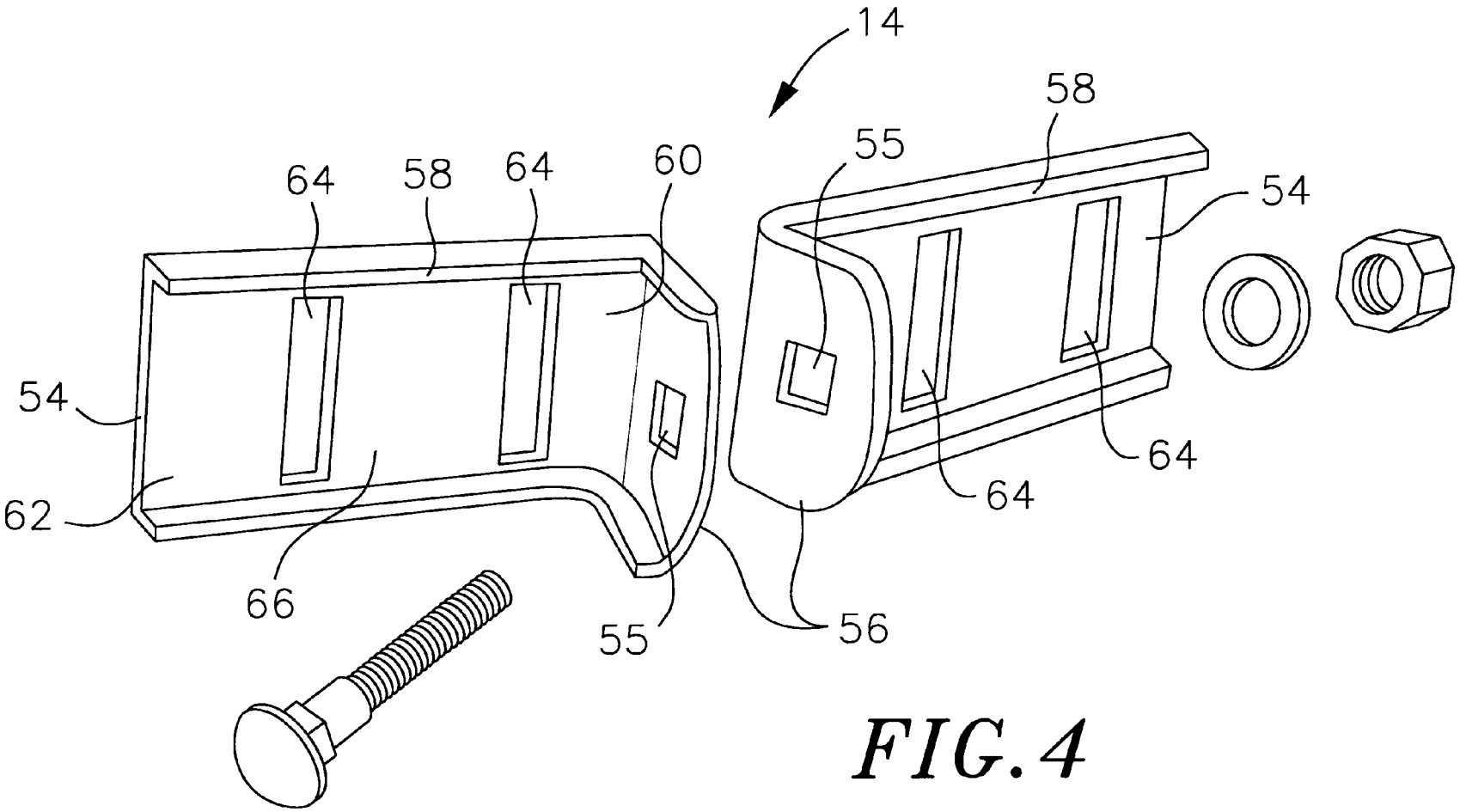
FIG. 4 is a perspective view of the tension buckles of the fastening system in FIG. 1.

With reference to FIG. 4, the tension buckles 14 include an elongated member 54, an arm 56 and flanges 58. The elongated member 54 includes a first end 60, a second end 62 and a plurality of apertures 64, wherein the apertures 64 are disposed between the first and second ends 60, 62. The arm 56 includes an aperture 55 and is coupled to the first end 60 of the elongated member 54, wherein the arm 56 extends substantially perpendicularly therefrom such that an L-shape is formed upon coupling. In some preferred embodiments, the arm 56 and elongated member 54 are manufactured as a single piece.

The flanges 58 extend along both sides of the elongated member 54 and the arm 56 such that a channel 66 is formed. Some preferred embodiments do not include a flange 58. Reference is further made to U.S. Pat. No. 5,487,518 to McCraney, which is incorporated herein by reference, wherein a preferred embodiment of the tension buckles 14 is described.

Figure 5B:
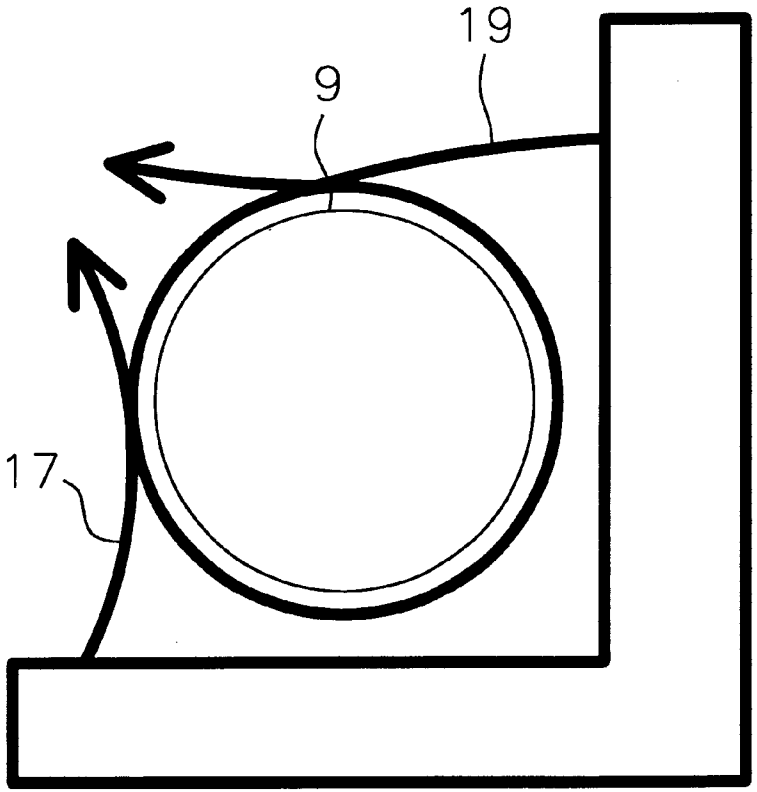
FIG. 5*b* is a top view of the fastening system of FIG. 1 securing a water heater in a corner of two adjoining walls.
Figure 5A:
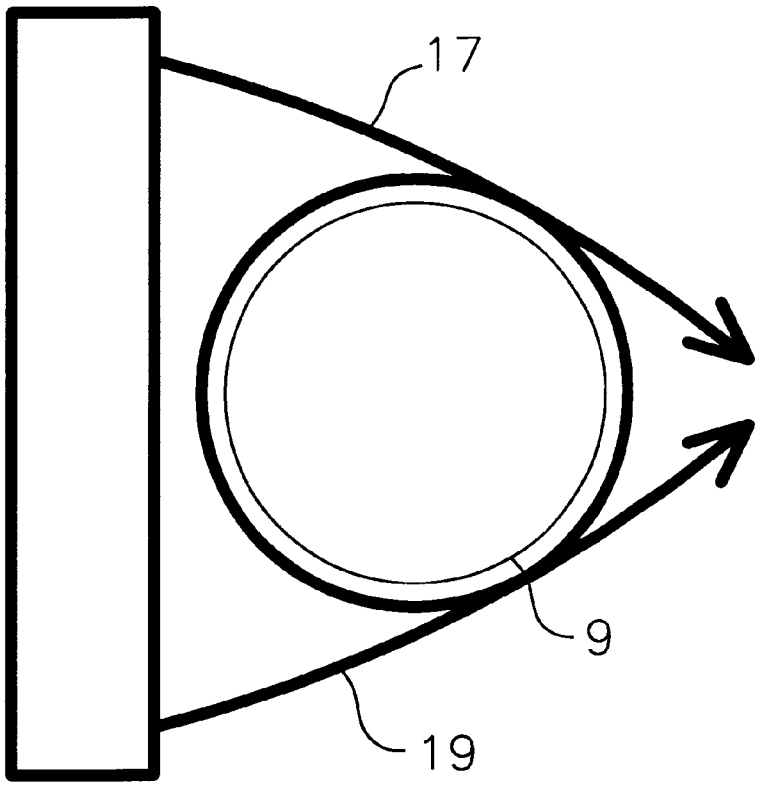
FIG. 5*a* is a top view of the fastening system of FIG. 1 securing a water heater to a wall.

With reference again to FIG. 1, in one preferred embodiment, the straps 16 include a short strap 17 and a long strap 19, wherein the short strap 17 and the long strap 19 each include a first end 68 and a second end 70. Preferably, the short strap 17 and the long strap 19 are substantially identical in nature, for example, the same material and shape, except with respect to their respective lengths. Both the short strap 17 and the long strap 19 can vary in length depending upon the size of the water heater 9 and the placement of the heater 9. Referring to FIGS. 5*a* and 5*b*, the short strap 17 must be long enough to extend from the wall to the front of the water heater 9. By contrast, the long strap 19 must be long enough to extend from the wall to the front of the water heater 9 and wind around the circumference of the water heater 9 for one turn so that it can meet the short strap. Preferably, the straps 16 are made from a malleable alloy, such as, for example, aluminum or sheet metal, although any material strong enough to maintain a water heater 9 in place (potentially during a disaster), such as, for example, leather, is suitable.

Figure 6:
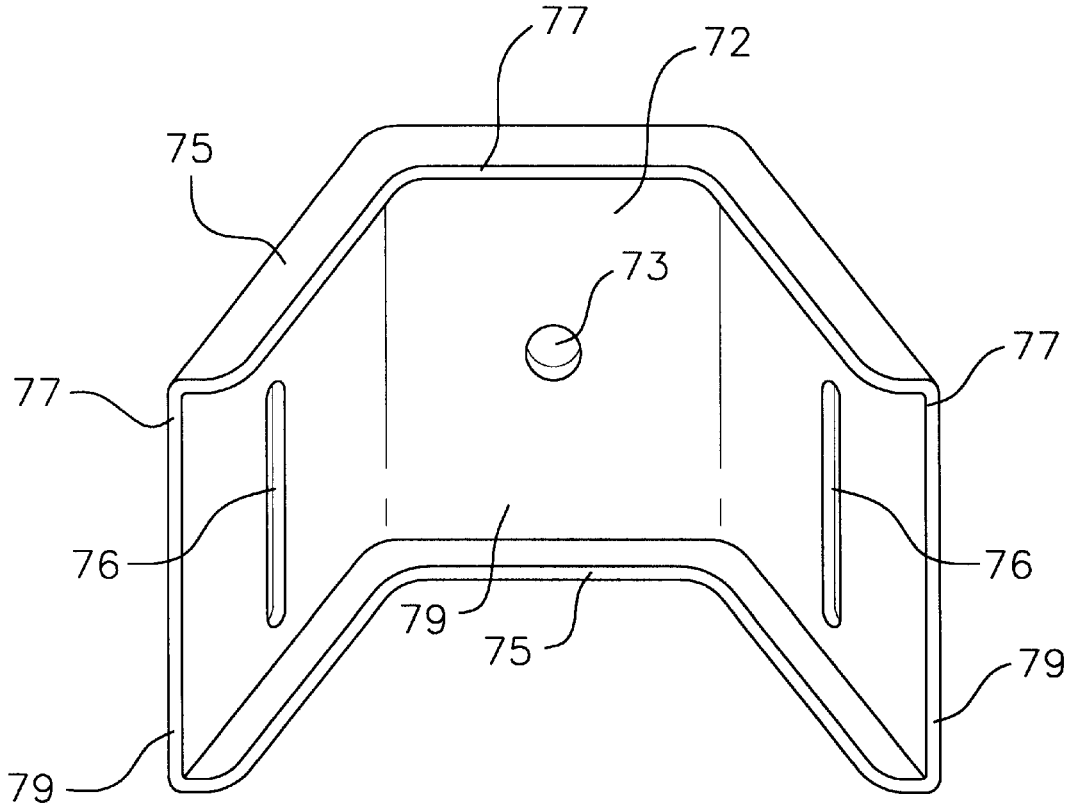
FIG. 6 is a perspective view of a spacer of the fastening system FIG. 1.

With reference to FIG. 6, the preferred embodiment of the spacer 18 includes a back member 72 including an aperture 73, two legs 74 and flanges 75, wherein the back member 72 and the legs 74 each include a top 77 and a bottom 79. Each leg 74 includes an aperture 76 capable of receiving the long strap 19 and the legs are coupled to the back member 72, wherein the legs 74 and the back member 72 are positioned such that the apertures 76 in each of the legs 74 are aligned. The flanges 75 are coupled to both, and extend perpendicularly from, the top 77 and the bottom 79 of the legs 74 and the back member 72. In one preferred embodiment, the spacer 18 is mounted to the wall via the aperture 73. In some preferred embodiments, the back member 72 does not include an aperture 73.

Figure 7A:
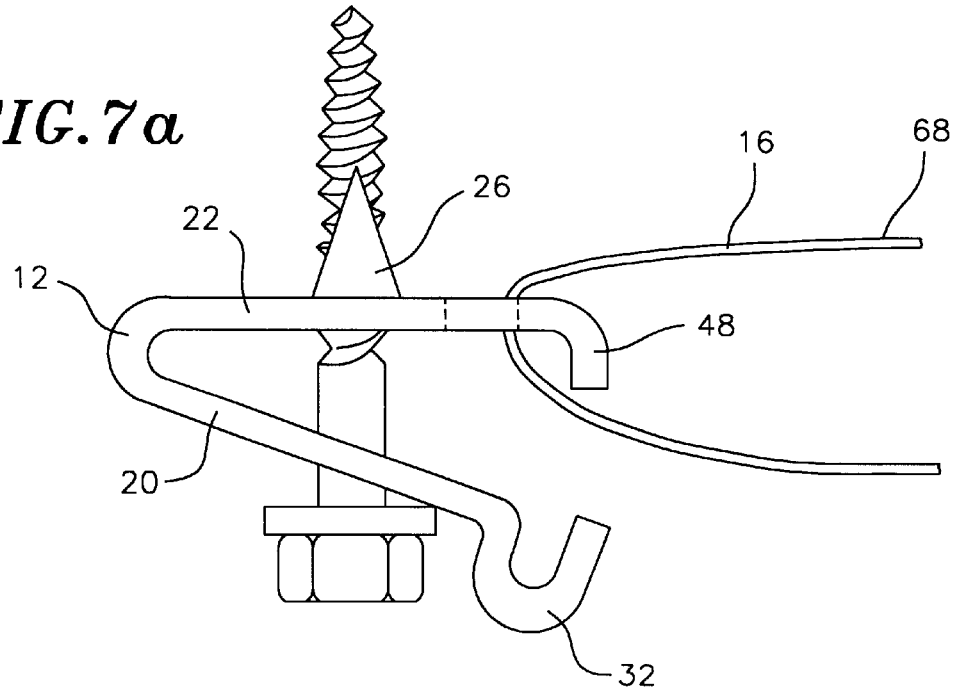
FIG. 7*a* is a top view of a strap threaded into the bracket of the fastening system of FIG. 1.
Figure 7B:
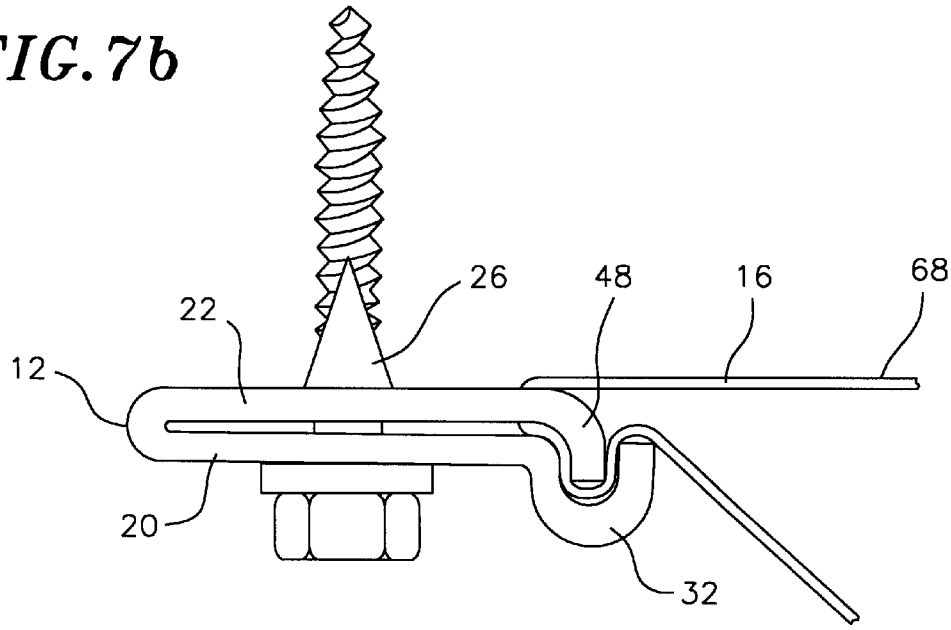
FIG. 7*b* is a top view of the strap fastened to the bracket of FIG. 7*a*.

With reference to FIGS. 1, 7*a* and 7*b*, the assembly and installation of the fastening system for a preferred embodiment will now be described. In operation, the first end 68 of the short strap 17 is pulled between the lip 48 and the channel member 32 and threaded through the aperture 46 in the bottom member 22 of a bracket 12. The short strap 17 is pulled through such that a portion of the short strap 17 can be pulled and folded underneath the bottom member 22. The first end 68 portion of the strap 17 is folded underneath the bottom member 22 behind the water heater 9.

After the short strap 17 is pulled through the bracket 12, the bracket 12 is appropriately positioned near the water heater 9 and loosely attached to the supporting structure in the environment, e.g., the wall, with a fastener passing through the apertures 34 and 46 in the top member 20 and bottom member 22, respectively, of the bracket 12 (see FIG. 2*a*). As the fastener is tightened, the top member 20 moves towards the bottom member 22 until the channel member 32 receives the lip 48. The fastener is tightened until the channel 32 is locked over the lip 48 or until the top member 20 meets the bottom member 22. Referring to FIG. 7*b*, as the screw is tightened, the portion of the short strap 17 disposed between the channel member 32 and the lip 48 is pushed into the channel 32 and held in place by the lip 48.

Figures 8A, 8B, 8C:
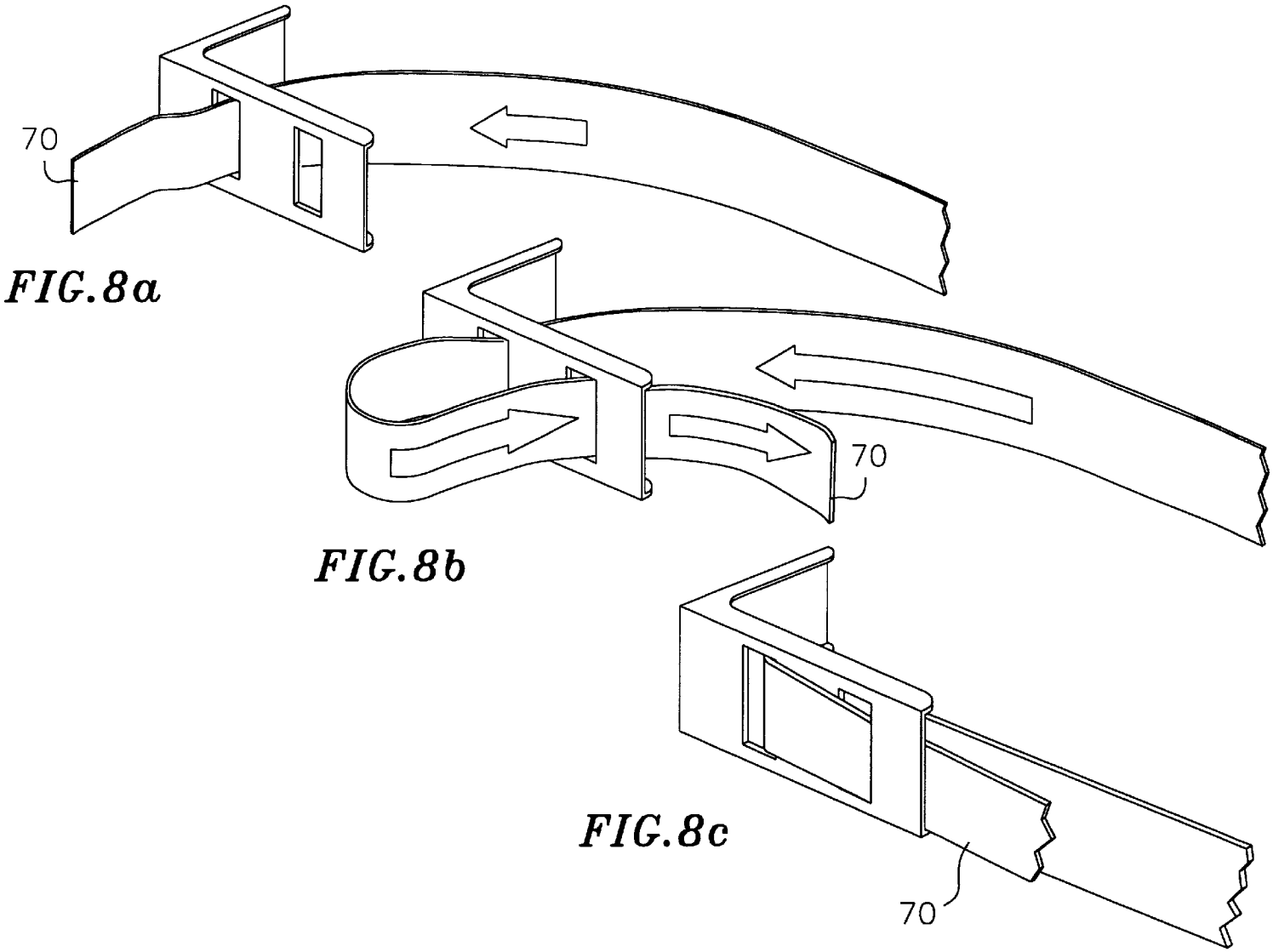
FIGS. 8*a*–8*c* illustrate a strap being threaded through a tension buckle.

After securing the first bracket 12 to the wall, the short strap 17 is threaded into one of the tension buckles 14. With reference to FIG. 4 and FIGS. 8*a*–8*c*, the second end 70 of the short strap 17 is threaded into (towards the water heater 9) the aperture 64 closest to the first end 60 of the elongated member 54 (FIG. 8*a*). The short strap 17 is then pulled out of (away from the water heater 9) the aperture 64 closest to the second end 62 of the elongated member 54 (FIG. 8*b*). The remaining portion of the short strap 17 is disposed within the channel 66 of the elongated member 54 (FIG. 8*c*). After the short strap 17 has been affixed at both ends, the long strap 19 is threaded into the second tension buckle 14 in the same manner as described above. Once both the short strap 17 and long strap 19 are threaded into their respective tension buckles 14, but before the long strap 19 is wound around the water heater, the tension buckles 14 are positioned such that the arms 56 reside adjacent each other and face outward from the water heater 9. A fastener, such as a nut and bolt, is then passed through the apertures 55 and secured such that the arms 56 of the tension buckles 14 are apart from each other. Depending upon the manner in which the strap 16 is being attached, the tension buckles 14 may be tightly secured by the this fastener such that a tautness results. In other instances, the tension buckles 14 are loosely secured until the long strap 19 is wound around the water heater and secured to the wall.

Once the straps 16 are threaded into the tension buckles 14, the long strap 19 is then wound around the circumference of the water heater 9 (see FIGS. 5*a* and 5*b*). While the long strap 19 winds around the water heater, the long strap is threaded through the apertures 76 in each of the legs 74 of the spacer 18 (see FIG. 6) such that the back member 72 resides adjacent the wall and the legs 74 extend toward the water heater 9, as shown in FIG. 1. The spacer 18 is then slid along the long strap 19 to a position between the back of the water heater 9 and the supporting structure. In instances where the restraining device is retrofit ting an existing water heater, the spacer 18 can be slid behind the water heater without requiring that the spacer 18 be attached to the wall. However, in some preferred embodiments, the spacer 18 is attached to the wall via with a fastener, such as a screw, passing through the aperture 73 of the spacer 18. As the long strap 19 completes its turn around the water heater 9, it preferably passes either above or below the tension buckles 14.

Next, the long strap 19 is threaded through a bracket 12. The bracket 12 is slid to its mounting position on the side of the water heater opposite to the short strap, wherein a bolt or other securing member is passed through the apertures on the arms 56 of the tension buckle 14 and tightly secured. The straps 16 are then pulled until the straps 16 snugly surround the water heater 9.

Points of adjustability with respect to the preferred embodiment include both the brackets 12 and the tension buckles 14. Indeed, the water heater 9 can be secured by sliding the brackets 12 along any portion of either short strap 17 or long strap 19, or by tightening the bolt securing the tension buckles 14 in front. The manner of adjustment is dictated, in part, by the environment in which the water heater is installed. For example, a tight corner may prohibit tightening of one of the brackets 12.

Preferably, the water heater 9 is restrained in two locations, one location toward the upper end of the water heater and the other location toward the lower end. For instance, the water heater can be strapped within the upper one third of the water heater 9 and also strapped at a second location just above the heater controls, such as, for example, 4 inches above the heater controls. Double strapping will improve the stability of the water heater 9 with respect to shaking and rocking motions. This reduces motion during shaking and rocking, thereby minimizing the potential for the water heater to break away from the wall or break away from the gas lines. In either situation, the dwelling could suffer damage from fire, flood (due to the body of the water heater breaking) or both.

Figure 9A:
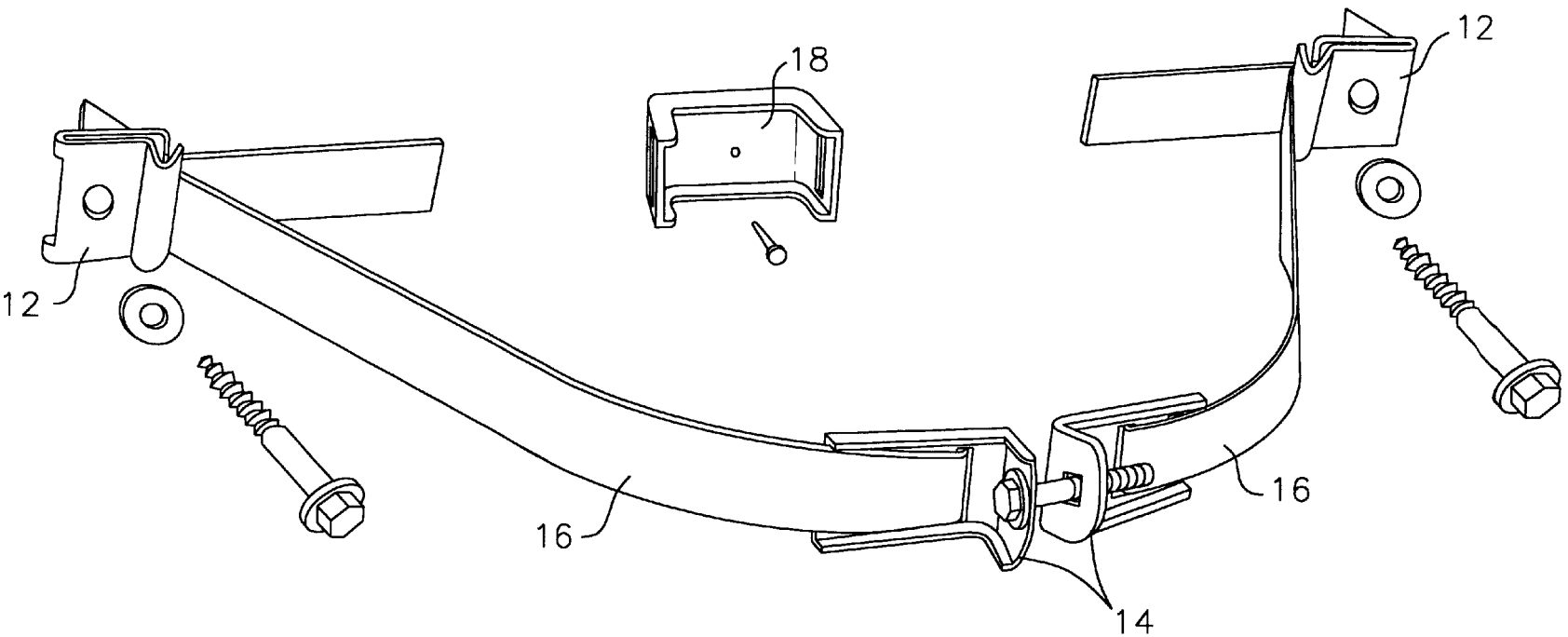
FIG. 9*a* is a perspective view of a second preferred embodiment of the fastening system of the present invention.
Figure 9B:
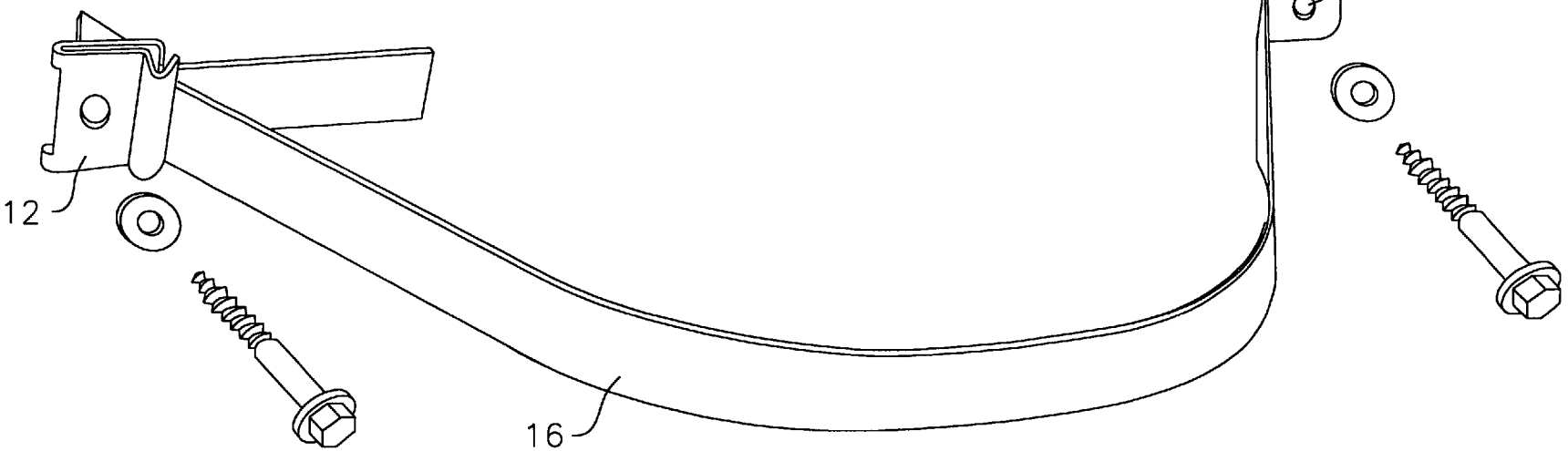
FIG. 9*b* is a perspective view of a third preferred embodiment of the fastening system of the present invention without the tension buckles or spacer and with only one bracket.
Figure 10:
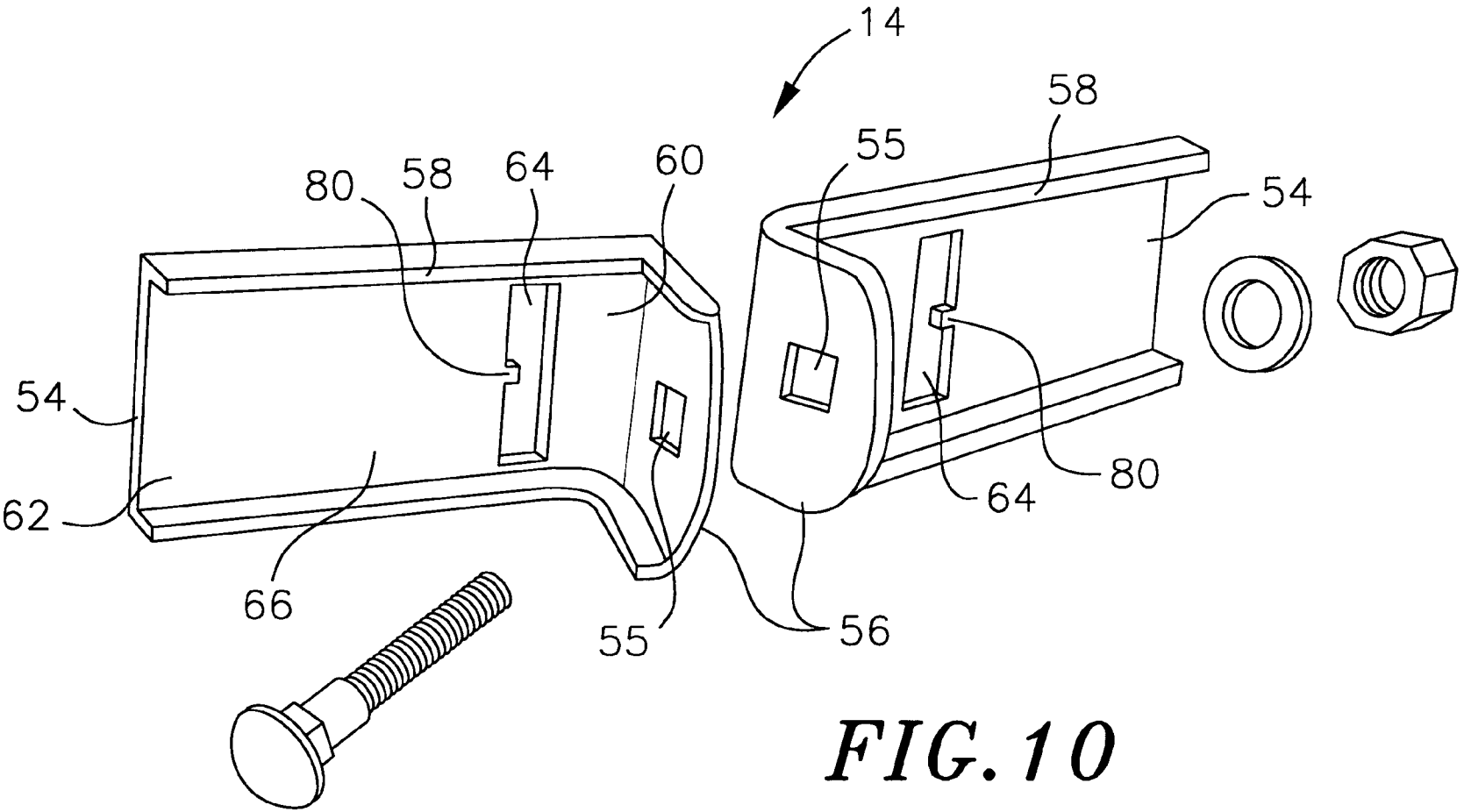
FIG. 10 is a perspective view of an alternative embodiment of the tension buckles of the fastening system of FIG. 1.
Figure 11A:
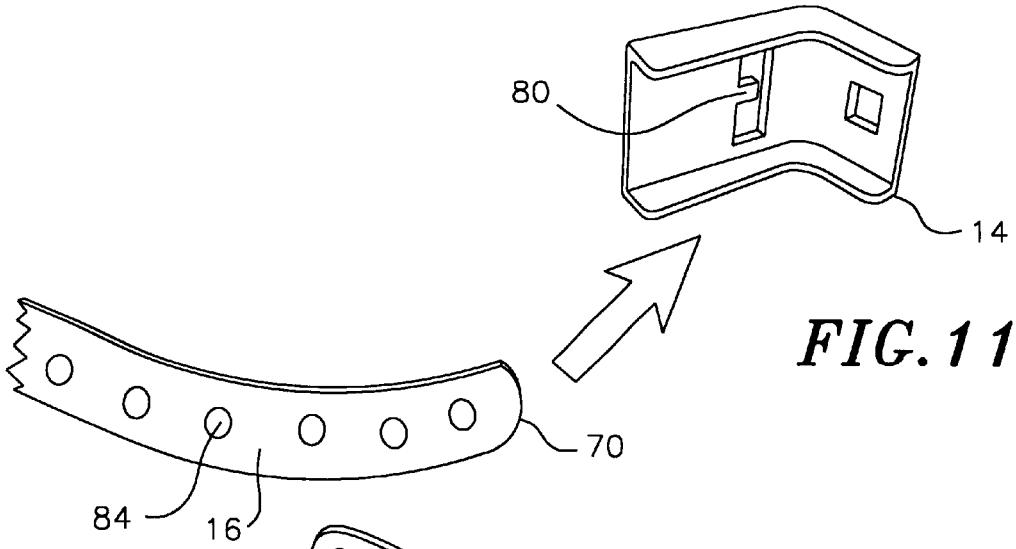
FIGS. 11*a*–11*c* illustrate a strap with perforations being threaded through the tension buckle of FIG. 10.
Figure 11B:
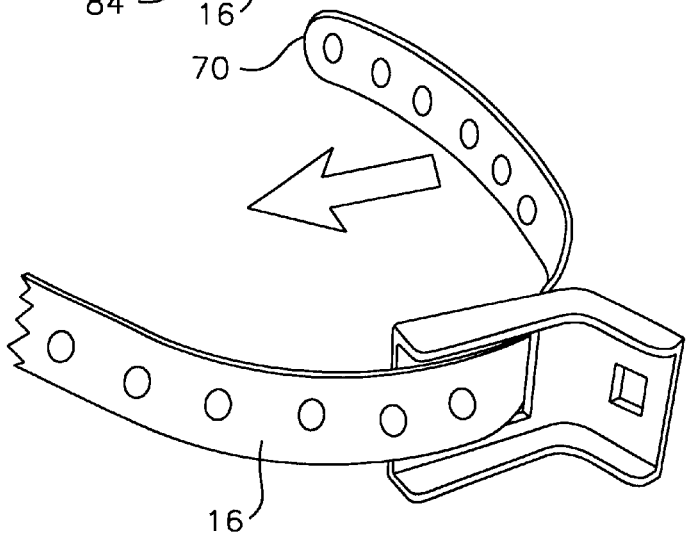
Figure 11C:
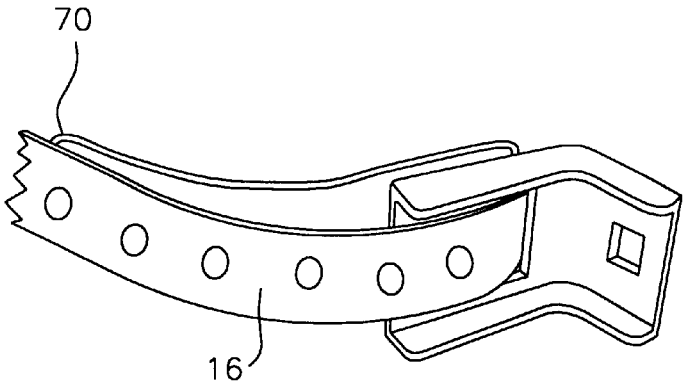
Figure 12:
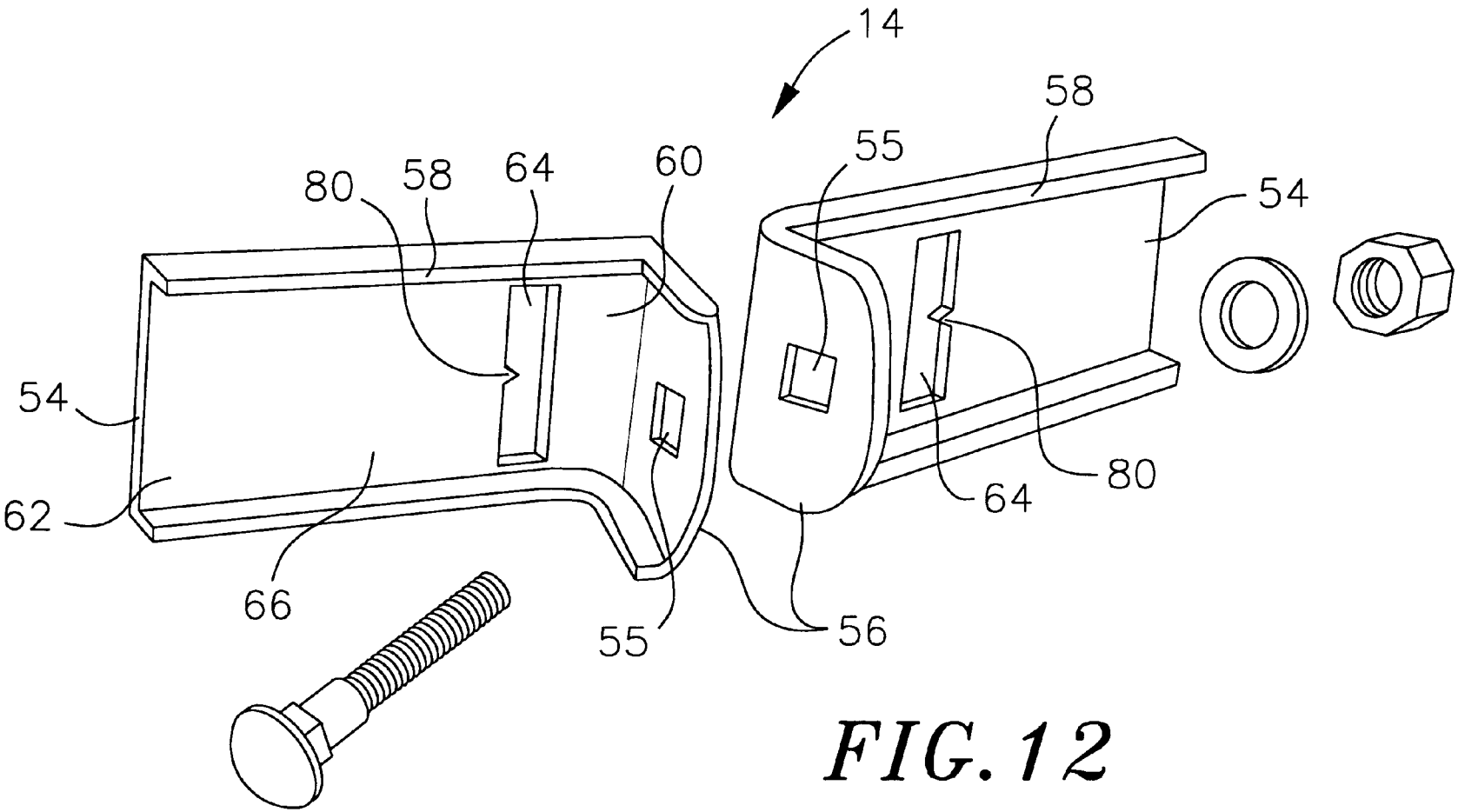
FIG. 12 is a perspective view of a second alternative embodiment of the tension buckles of the fastening system of FIG. 1.
Figure 13A:
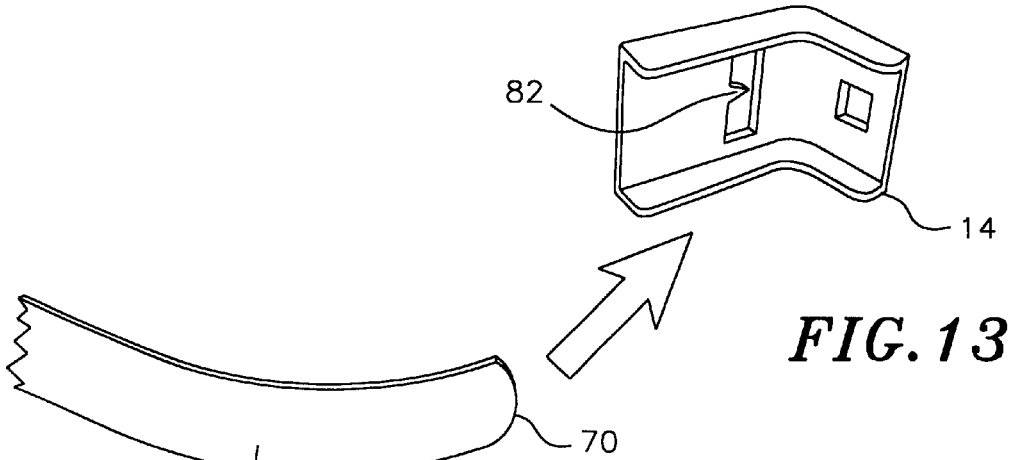
FIGS. 13*a*–13*c* illustrate a strap being threaded through the tension buckle of FIG. 12.
Figure 13B:
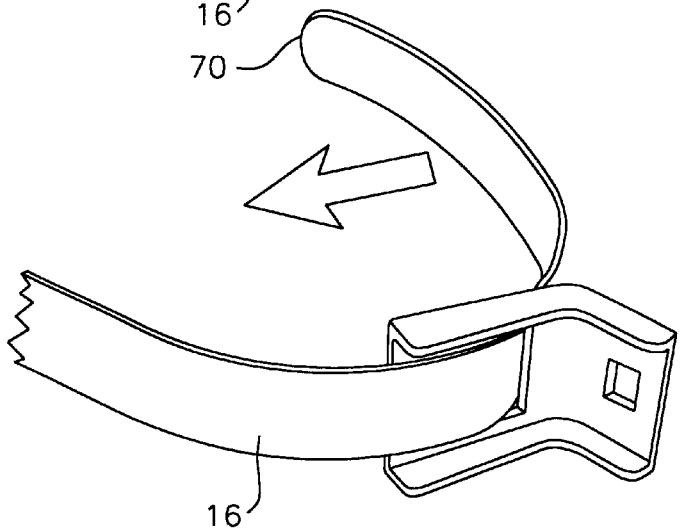
Figure 13C:
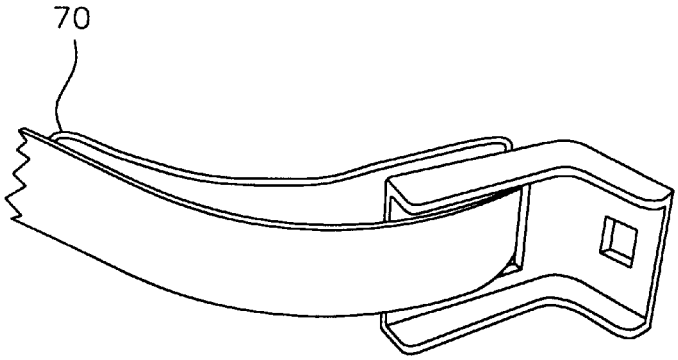

Other preferred embodiments do not include a long strap 19, and thus, do not wrap a long strap 19 around the circumference of the water heater. Instead, another short strap 17 substitutes for the long strap 19. With reference to FIG. 9*a*, the straps 16 in this embodiment are attached in the same manner as described above for the attachment of the short strap 17. All other applicable adjustments are made in the manner described above. With reference to FIG. 9*b*, in another preferred embodiment, the fastening system does not include tension buckles 14 and only one strap 16 is used. In this embodiment, one end of the strap 16 includes an aperture 78 for directly bolting the strap to the wall stud. The manner of attachment to the bracket 12 is the same as described above. As such, in these embodiments, the brackets 12 are capable of restraining the water heater 9 as a solo feature.

Another embodiment for tension buckles 14 and straps 16 is shown in FIGS. 10 and 11*a*–11*c*. In this embodiment, the straps 16 have perforations 84 and the aperture 64 in the elongated member 54 of the tension buckle 14 contains a tab 80. When the strap 16 is threaded through the aperture 64, a selected perforation 84 is engaged by the tab 80 to prevent the strap 16 and tension buckle 14 from sliding with respect to each other. Assembly of the strap 16 to the tension buckle 14 is easier because it is no longer necessary to thread the strap 16 through a second aperture 64 of the tension buckle 14 (such as shown in FIGS. 5*a*–5*b*) to secure the strap 16.

A further embodiment for tension buckles 14 is shown in FIGS. 12 and 13*a*–13*c*. In this embodiment, the aperture 64 in the elongated member 54, contains a pointed tab 82. While a tension buckle 14 with a pointed tab 82 can be used with a strap 16 with perforations 84, the main advantage of the pointed tab design is that a non perforated strap can be utilized. During assembly, as the straps 16 are tightened, the pointed tab 82 will puncture its own hole in strap 16, thereby obviating the need for a perforated strap, while maintaining the ease of installation advantage of the embodiment shown in FIG. 10.

The above described preferred embodiments are not meant to limit the invention. Rather, all permutations of use of various features are intended. Thus, for example, use of a restraining device without a spacer 18, but with a tension buckle 14 is also possible.

Although the foregoing describes the invention with preferred embodiments, this is not intended to limit the invention. Rather, the foregoing is intended to cover all modifications and alternative constructions falling within the spirit and scope of the invention.

I claim:

1. A disaster safety assembly comprising:

a water heater having a rear portion facing a supporting structure and a front portion facing away from the supporting structure; and at least one elongated, bendable strap extending from the supporting structure to the front portion, then to the rear portion, then to the front portion making a complete circuit of the water heater.

2. The disaster safety assembly of claim 1 wherein the first strap is fastened to the supporting structure by a fastener.

3. The disaster safety assembly of claim 1 wherein the first strap is fastened to the supporting structure by a second elongated, bendable strap having a first end and a second end, the second strap being shorter than the first strap, and wherein the first end of the second strap is fastened to the supporting structure and the second end of the second strap is fastened to the second end of the first strap.

4. The disaster safety assembly of claim 1 further comprising a spacer located on the strap between the water heater and the supporting structure.

5. The disaster safety assembly of claim 4 wherein the spacer has at least one arm, and wherein the arm of the spacer defines an opening through which the strap can pass.

6. The disaster safety assembly of claim 5 wherein the strap is inserted through the opening in the spacer arm, and wherein the strap is placed around the water heater such that the spacer rests on the strap between the water heater and the supporting structure.

7. The disaster safety assembly of claim 4 wherein the back of the spacer defines an opening through which a fastener can pass.

8. The disaster safety assembly of claim 4 wherein the spacer is fastened to the supporting structure.

9. The disaster safety assembly of claim 4 wherein the spacer has two arms, each arm defining an aperture through which the strap can pass, and wherein the strap is threaded through the apertures.

10. The disaster safety assembly of claim 4 wherein the back of the spacer defines an opening through which a fastener can pass, and wherein the spacer is threaded to the supporting structure.

11. A system for securing a water heater to a supporting structure, comprising:

a first strap sized to make a complete circuit of the water heater;

a second strap;

a first tension buckle for receiving the first strap;

a second tension buckle for receiving the second strap; and a fastener for connecting the first and second tension buckles.

12. The system of claim 11 further comprising:

a first fastener for securing the first strap to the supporting structure; and a second fastener for securing the second strap to the supporting structure.

13. The system of claim 12 wherein the first and second fasteners each comprise a bracket mountable to the supporting structure, the bracket being configured to move between an open position to receive the respective strap and a closed position to clamp the respective strap.

14. The system of claim 12 wherein the first and second fasteners each define an aperture for receiving the respective strap.

15. The system of claim 11 wherein the first tension buckle defines an aperture for receiving the first strap and includes a tab within the aperture for engaging the first strap.

16. The system of claim 11 wherein the second strap is sized to extend from the supporting structure to the front of the water heater.

17. A method of securing a water heater having a rear portion facing a supporting structure and a front portion facing away from the supporting structure, the method comprising:

providing a first elongated, bendable strap having a first end and a second end;

fastening the first end of the strap to the supporting structure;

wrapping the strap around the water heater such that the strap extends from the supporting structure to the front portion, then to the rear portion, then to the front portion making a complete circuit of the water heater; and fastening the second end of the strap to the supporting structure.

18. The method of claim 17 wherein the second end of the first strap is fastened to the supporting structure by a fastener.

19. The method of claim 17 further comprising locating a spacer on the strap between the water heater and the supporting structure.

20. The method of claim 17 wherein the second end of the first strap is fastened to the supporting structure by a second elongated, bendable strap having a first end and a second end, the second strap being shorter than the first strap, and wherein the first end of the second strap is fastened to the supporting structure and the second end of the first strap is fastened to the second end of the second strap.

21. The method of claim 20 further comprising attaching the second end of the first strap to a first tension buckle and the second end of the second strap to a second tension buckle, and connecting the two tension buckles with a fastener.

* * * * *

UNITED STATES PATENT AND TRADEMARK OFFICE

CERTIFICATE OF CORRECTION

PATENT NO. : 6,340,143 B1
DATED : January 22, 2002
INVENTOR(S) : William J. Mccraney It is certified that error appears in the above-identified patent and that said Letters Patent is hereby corrected as shown below:

Column 3,
Line 19, after "FIG." insert -- 1. --.

Column 6,
Line 49, change "retrofit tin" to -- retrofitting --.

Signed and Sealed this

Nineteenth Day of November, 2002

*Attest:*

*Attesting Officer*

JAMES E. ROGAN
*Director of the United States Patent and Trademark Office*